United States Patent [19]

Moestue

[11] 4,135,448

[45] Jan. 23, 1979

[54] MECHANISM FOR CLEANING A CYLINDER OF AN OFFSET LITHOGRAPHIC PRINTING PRESS

[76] Inventor: Hans J. Moestue, Osteraskroken 9, N-1345 Osteras, Norway

[21] Appl. No.: 811,831

[22] Filed: Jun. 30, 1977

Related U.S. Application Data

[63] Continuation-in-part of Ser. No. 612,325, Sep. 11, 1975, abandoned.

[30] Foreign Application Priority Data

Sep. 11, 1974 [NO] Norway ..... 743261
Aug. 27, 1975 [DE] Fed. Rep. of Germany ..... 2538067

[51] Int. Cl.[2] ..... B41F 35/06; B41L 41/06
[52] U.S. Cl. ..... 101/425; 101/156
[58] Field of Search ..... 101/425, 169, 157, 423, 101/424, 156, 160, 162, 164, 165, 166, 168, 350; 15/256.5, 256.51, 256.52, 256.53, 256.6, 105

[56] References Cited

U.S. PATENT DOCUMENTS

| | | | |
|---|---|---|---|
| 282,995 | 8/1883 | Lee | 101/167 |
| 1,889,376 | 11/1932 | Renck | 101/148 |
| 2,525,982 | 10/1950 | Wescott | 101/425 |
| 2,672,812 | 3/1954 | Luehrs | 101/366 |
| 3,084,626 | 4/1963 | Stobb | 101/425 |
| 3,120,805 | 2/1964 | Simon | 101/425 |
| 3,207,070 | 9/1965 | Klingler et al. | 101/366 |
| 3,309,993 | 3/1967 | Grembecki et al. | 101/425 |
| 3,411,444 | 11/1968 | Boneschi | 101/425 |
| 3,507,215 | 4/1970 | Schuhmann | 101/148 |
| 3,583,684 | 6/1971 | Schippers | 259/105 |
| 3,658,003 | 4/1972 | Johnson | 101/425 X |
| 3,735,702 | 5/1973 | Kossak | 101/425 |
| 3,850,099 | 11/1974 | Laben | 101/425 |

FOREIGN PATENT DOCUMENTS

| | | | |
|---|---|---|---|
| 2052996 | 5/1972 | Fed. Rep. of Germany | 101/425 |
| 6413822 | 11/1965 | Netherlands | 101/167 |
| 306488 | 2/1929 | United Kingdom | 101/156 |

*Primary Examiner*—J. Reed Fisher
*Attorney, Agent, or Firm*—Watson, Cole, Grindle & Watson

[57] ABSTRACT

An improved mechanism for cleaning a driven blanket cylinder in an offset lithographic printing press is described. In the mechanism, a wash cloth is fed from a magazine roller over a pressure roller to a take-up roller. The pressure roller can be brought to bear against the dirty surface of the blanket cylinder with the wash cloth therebetween. The wash cloth is wetted by spraying a cleaning fluid thereon immediately prior to its encountering the pressure roller. The wet wash cloth is thus brought into contact with the dirty surface of the blanket cylinder which is then rotated against the cloth to cleanse the surface. After the surface is clean, dry cloth can be brought into contact with the blanket cylinder by merely not activating the fluid spray. Means are provided in the preferred embodiments for agitating the cleaning fluid to keep it well-mixed and means are also provided for collecting and reusing any excess cleaning fluid which may be dispensed.

10 Claims, 6 Drawing Figures

MECHANISM FOR CLEANING A CYLINDER OF AN OFFSET LITHOGRAPHIC PRINTING PRESS

CROSS-REFERENCE TO RELATED APPLICATION

This application is a continuation-in-part of my earlier, copending application, Ser. No. 612,325, now abandoned, filed Sept. 11, 1975.

BACKGROUND OF THE INVENTION

1. Field of the Invention

The present invention concerns a mechanism for cleaning a driven blanket cylinder of an offset lithographic printing press by means of a wash cloth which is unwound incrementally from a magazine roller, is wetted with a cleaning fluid, is conducted over a pressure mechanism and pressed against the blanket cylinder to be cleaned and is wound up on a take-up roller.

2. Prior Art

In offset lithographic printing presses, the surfaces of the blanket cylinders become contaminated periodically during use. In such an offset lithographic printing press, the driven blanket cylinder generally becomes covered with a variety of different substances some of which are water soluble and some of which are not. To clean such a cylinder effectively, it is necessary that the blanket cylinder be washed with materials which are solvents for each of the contaminants generally found on the surface of the cylinder. Usually, this requires the application of both water and other, nonaqueous solvents to the surface. Furthermore, before the blanket cylinder may be reused, it must be dried of the solvents utilized during its cleaning. Furthermore, for the various solvents which are applied to be fully effective, it is preferable that in at least some instances, the previously applied solvent be essentially removed prior to application of subsequent solvents.

In most offset lithographic printing press operations, it is necessary that the blanket cylinder be cleaned several times a day. To date, no commercially available apparatus can clean the blanket cylinder rapidly and completely so that the offset lithographic printing press is not removed from service for any extended period of time. Although a number of schemes have been suggested in the prior art, none has been commercially accepted since they are not flexible enough or fast enough to achieve suitable results. As a result, the conventional means of cleaning the blanket cylinders of offset lithographic printing presses remains the manual application and wiping of the cylinder by an operator. Obviously, such a technique is slow and subject to unpredictable results.

Attempts have been made to mechanize this cleaning process. Such a mechanism is shown, for example, in U.S. Pat. No. 2,525,982, to Wescott wherein the wash cloth in the area of the surface to be cleaned on the driven blanket cylinder is pressed thereagainst by a pad. Wescott teaches an apparatus in which a cleaning cloth is manually advanced between a pair of reels. In between the two reels, the cleaning cloth advances over the surface of a generally T-shaped pad which may be pressed against the surface of the blanket cylinder with the wash cloth between the pad and the cylinder. An appropriate cleaning solution is applied to the cloth through the pad by wetting a wick attached to the back of the pad with that desired cleaning solution. The cleaning fluid is then transported to the surface of the pad by capillary action and there wets the cleaning cloth. The cleaning cloth being a highly porous material transports the cleaning solution to the surface of the driven cylinder. During the cleaning of the cylinder, the blanket cylinder rotates relative to the cleaning cloth and a wiping action of the surface is thereby achieved. When the wash cloth becomes soiled, the pad is retracted from the surface of the cylinder and a new section of clean wash cloth is advanced into position over the pad.

While, in principle, this arrangement is advantageous for the cleaning of such cylinders in offset lithographic printing presses, a number of disadvantages occur which prevent the apparatus from performing acceptably. For example, the apparatus is too slow for use in offset lithographic presses where the blanket cylinder is turning at essentially operational speeds. It is necessary to reduce the press speed to the "crawling" mode for cleaning. A definite time lag occurs between the application of the cleaning solution to the wick and the initial arrival of that solution at the surface of the blanket cylinder where it can be utilized. This time lag has a corollary effect which is even more disadvantageous. Once the application of cleaning fluid to the surface of the wick has been discontinued, a considerable period of time elapses before that cleaning solution ceases to arrive at the front surface of the pad over which the cleaning cloth passes. This is similar to an attempt to totally remove a fluid from a sponge. Therefore, the pad cannot be used as part of an apparatus for applying a dry cloth to the surface of the cylinder for that considerable time after the cleaning of that surface. The drying action, which is required, must either be done manually or by some other ancillary apparatus which is neither shown nor suggested in Westcott.

Furthermore, as stated above, it is often necessary when cleaning the surface of such cylinders that more than one cleaning agent be utilized in a sequential program. The examplary agents are water and other, nonaqueous solvents for printing inks. The Wescott apparatus cannot reasonably be utilized for such sequential application of totally different solvent materials. The time lag between the discontinuance of the application of one solvent to the wick and the time necessary to purge the wick of that solvent is such that a single pad, wick and cloth combination can only be utilized practically to apply a single solvent material to the surface of the cylinder or to dry the surface. Therefore, if more than one solvent is necessary for the cleaning of such an offset lithographic press cylinder, more than one of the Wescott apparatus must be supplied for applying that solvent and another apparatus for the drying function.

The pad which is utilized to press the cleaning cloth against the surface of the blanket cylinder in Wescott is also subject to rapid contamination and subsequent inoperability thereby producing an apparatus in which the pad and wick combination must be frequently changed. That is, the wash cloth material necessarily must be highly porous in order to achieve its cleansing function. That porosity allows the contaminated material removed from the surface of the blanket cylinder to be transported back through the cloth and into at least the surface of the pad forcing that cloth against the cylinder. If this material dries and cakes into the pores of the pad, it becomes increasingly difficult for the cleansing solution to advance through the pad to the wash cloth and the blanket cylinder of the offset lithographic printing press thereby requiring either changing or separate cleaning of the wick and pad. Furthermore, once contaminated, the pad can serve as a means for supplying a contaminated cleaning agent to the blanket cylinder thereby degrading the possible end result.

Also, no means are provided in the Wescott apparatus for retaining any degree of tension in the web which is being advanced over the pad. Necessarily, as the web passes, and is wet with the cleaning solution, the web stretches, particularly under the wiping action of the blanket cylinder. As a result, considerable slack necessarily results in the web. Such slack will also tend to contaminate other areas of the apparatus and is, in general, highly undesirable in commercial offset lithographic printing presses.

Another prior art mechanism is shown in West German O. S. No. 2,052,996 to Lawrence. This apparatus utilizes a cleaning web which is pressed against a surface to be cleaned on a drum by a pressure roll. The web is, however, not moistened with a cleaning fluid at any time; the web has a coating on a web of polyurethane, a plain paper or cloth. In other words, any cleaning agent is impregnated into the web at all times. The web is incrementally advanced by pivoting the apparatus vertically by gravity during the time that the pressure roll is traversing the axial space in the surface of the drum. During this time, gravity causes the mechanism including the roll to pivot downwardly. Such action allows the ratchet mechanism shown in FIG. 1 to incrementally advance the web if the rotational speed is sufficiently slow to allow a significant vertical pivoting of the apparatus.

Such rotational speeds are obviously far below the normal operational speeds of modern offset lithographic printing presses. Furthermore, no flexibility is allowable as to type or presence of cleaning agent. The cleaning agent impregnated into the web is always present.

In other areas of the printing industry, it has been known to use wiping webs for removal of excessive deposits of ink and for directing ink into desired areas of a plate and removing ink from other areas. For example, U.S. Pat. No. 282,995 to Lee shows the use of a series of intermittently advanced webs for improved inking of the engraved printing plates of an intaglio printing press. Some of the webs are premoistened and some are not. However, cleaning and removal of inks and other contaminants is not intended or desired. Furthermore, no flexibility exists for a web's condition, i.e., wet or dry. Hence, this apparatus cannot be transferred directly into an offset lithographic printing press, considerable unsuggested modification must first be made.

SUMMARY OF THE INVENTION

The present invention avoids these disadvantages of the prior art. Its principal object is to propose a mechanism of the type named at the outset with which a superior washing effect can be realized for the blanket cylinder of an offset lithographic printing press which has a constructionally simple mechanism and method.

A second object of the invention is to provide such an apparatus which can be applied to offset lithographic printing presses and used at the normal operational speeds of those presses to achieve uniform results.

The invention in its broadest aspects is a mechanism for cleaning a driven blanket cylinder of an offset lithographic printing press. The mechanism includes a magazine roller, a wash cloth web, means for incrementally advancing the wash cloth from the magazine roller, a pressure mechanism which may be pressed against the blanket cylinder to be cleaned and over which the advancing wash cloth web is incrementally advanced in a transport direction, and a take-up roller for rewinding the wash cloth web. Means are provided for moving the pressure mechanism into and out of contact with the driven blanket cylinder with the wash cloth therebetween. The pressure mechanism includes a pressure roller and the wash cloth web is incrementally advancible while the pressure roller and driven blanket cylinder are out of contact. Means are also provided in juxtaposition to the pressure roller for selectively dispensing at least one cleaning fluid onto the wash cloth web immediately before the wash cloth web contacts the pressure roller.

More specifically, the present invention is characterized by the fact that the pressure mechanism is designed as a pressure roller, in front of which a spray tube is arranged for dispensing the cleaning fluid onto the wash cloth web immediately prior to passing over the pressure roller.

The cleaning fluid is thus applied through the spray tube at as short a distance as possible from the washing site. With the named measures, it is possible to create precisely limited wetted areas and precisely limited dry areas on the wash cloth web so that the surface to be cleaned on the driven blanket cylinder can be processed selectively in a precise manner with either a wet or with a dry wash cloth. Due to this, a very basic cleaning is possible with a minimal consumption of both wash cloth web and cleaning fluid.

It is preferable that the spray tube be arranged directly over the section of the wash cloth web to be sprayed. In this way, all of the cleaning fluid arrives on the wash cloth. Basically, it is also possible to mount the spray tube under the section of the cleaning cloth to be sprayed so that the cleaning fluid is sprayed upwards through spray jets.

Moreover, it is advantageous if baffle plates are inserted in the cross-section of the spray tube. During the spraying operation, the baffle plates cause a mixing of the cleaning fluid, so that it is kept constantly in movement and its components cannot become separated. In addition, the baffle plates which are inserted in the cross-section of the spray tube reduce the volume of the cleaning fluid located there, so that a more precise control of the application of the cleaning fluid is possible. Also, leaking of the cleaning fluid is avoided.

It serves the same purpose when means are applied to the baffle plates to agitate the cleaning fluid during its passage. These means are, for example, spirals formed on the casing of a tube inserted in the cross-section of the spray tube.

Under the spray tube and the wash cloth, it is highly desirable that there be a catch pan for the cleaning fluid which might possibly leak through the wash cloth web. To reduce the washing medium consumption, it is preferable that a control mechanism be provided which immerses the wash cloth into the pan. This results in a still smaller washing medium consumption by pre-wetting the web and the catch pan is cleaned at the same time.

These and further objects, advantages and features of the present invention will be explained in more detail in the following description by means of a preferred embodiment, from which other important characteristics can be derived.

DETAILED DESCRIPTION OF THE PREFERRED EMBODIMENTS

Figure 1:
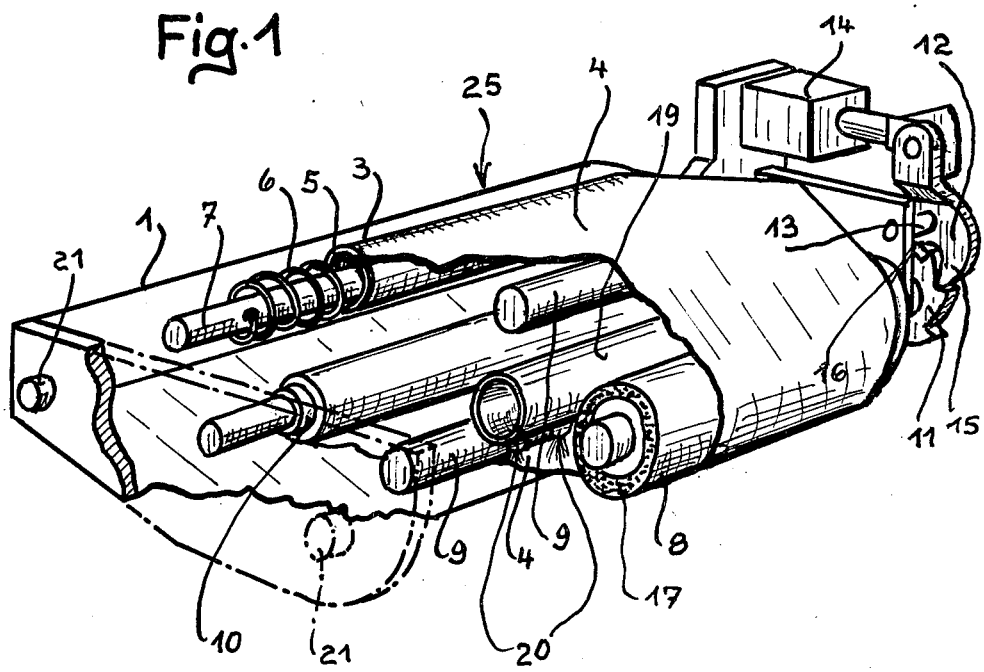
FIG. 1 is a perspective view of a mechanism according to the present invention in which the essential constructional elements are shown.

In referring to the various figures of the drawing hereinbelow, like reference numerals will be utilized to refer to identical parts of the apparatus.

Figure 2:
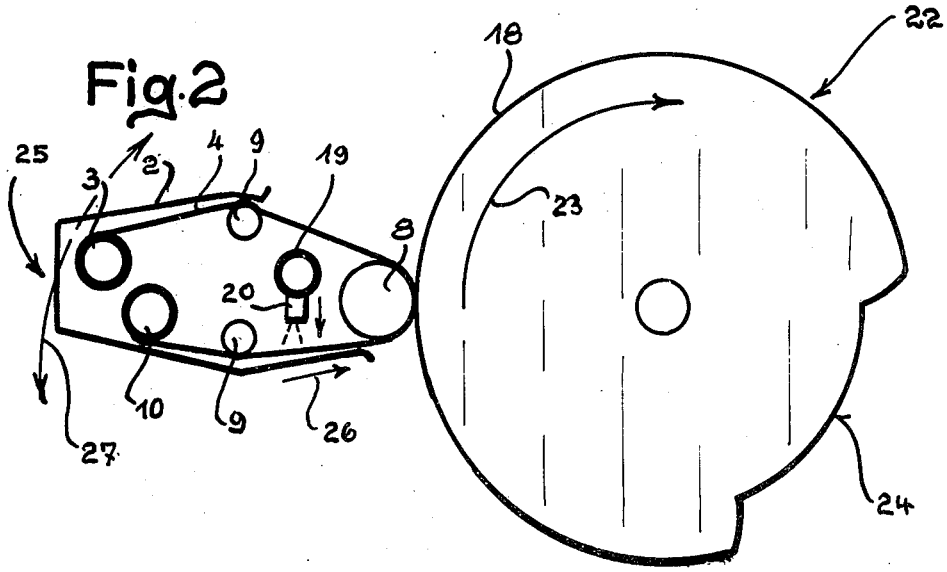
FIG. 2 is a schematic side view of the mechanism of FIG. 1 which may be used to explain the basic method of operation.

Turning initially to the fundamental method of operation of the mechanism as shown in FIGS. 1 and 2, a blanket cylinder 22 to be cleaned in an offset lithographic printing press is shown schematically in FIG. 2 and turns in the direction indicated by the arrow 23. It has a cylinder groove 24 in the blanket cylinder surface 18 which is to be cleaned. For this purpose, a mechanism designated generally by the reference numeral 25 is provided. The mechanism 25 has a housing 1, whose upper cover 2 is shown removed in FIG. 1 in order to be able to show the inside mechanism more clearly.

A take-up roller 3 with a wound-up wash cloth web 4 thereon is shown. The take-up roller 3 consists of a tube 5, in the inner part of which a spiral spring 6 is mounted and which is fastened on a shaft 7. The shaft is fixedly mounted in the housing 1 at both ends so that the whole take-up roller 3 can be replaced easily. The spring 6 connects the shaft 7 and the tube 5 so that the tube 5 can be turned while tightening the spring 6. The wash cloth 4 is fastened on one end to the tube 5 and is rolled up on it.

The mechanism 25 also contains a pressure roller 8, two guide rollers 9 and a magazine roller 10. All of the rollers are mounted rotatably in the housing 1. After the take-up roller 3 with the wash cloth 4 in the form of a rolled up sheet of suitable length has been inserted into the housing 1, the outside end of the sheet-like wash cloth 4 is guided around the guide rollers 9 and the pressure roller 8 and is fastened to the magazine roller 10. The magazine roller 10 can accordingly be turned in a suitable manner, e.g., with the help of a crank, to wind the wash cloth web 4 up on this roller until the wash cloth has been rolled up on the magazine roller 10 so far that it is fastened on the take-up roller 3 only at the one end. In this way the spring 6 is cocked fully. Thus, the spring 6 attempts to roll the wash cloth web 4 in the direction of the arrow 26 back onto the take-up roller 3.

This rewinding is accomplished with the aid of a locking mechanism and an interlocking mechanism for the magazine roller 10 as shown in FIG. 1, and a locking pawl mechanism for the pressure roller 8. The locking mechanism can include a pawl wheel 11 connected to the pressure roller 8 which is held fast against turning by a pawl 12. The pawl 12 is mounted rotatably about a bolt 13 and can be swung about the bolt 13 by control of a solenoid 14 which is connected to the opposite end of the pawl 12. The pawl 12 preferably has two teeth 15 and 16. The tooth 15 accomplishes the locking of the pawl wheel 11; while the other tooth 16 insures that the pawl swings back immediately after the pawl wheel 11 has been unlocked so that the pawl wheel 11 always turns by just one graduation when it is unlocked as the result of an impulse which is given to the solenoid 14.

The pressure roller 8 is provided with a layer 17 of relatively soft rubber which allows a certain flattening of the pressure roller 8 when the roller is pressed against the blanket cylinder surface 18 to be washed. Therefore, a pressure surface is formed between the pressure roller 8 and the wash cloth web 4 and the blanket cylinder surface 18 of, for example, about 1–2 cm in width.

In addition, a spray tube 19 having a plurality of depending jets 20 for feeding certain amounts of a selected washing fluid to the wash cloth web 4 is mounted in the housing 1. The spray tube 19 wets the wash cloth 4 near to the pressure roller 8 so that it is wet with the cleaning fluid at that place where the wash cloth lays on the blanket cylinder surface 18.

A pair of trunnions 21 are indicated on the end of the housing 1 around which the housing 1 can be moved. Thus, the entire mechanism 25, by means of a lifting mechanism which is not indicated in the Figures, may be moved in the direction of the arrow 27. By means of this, the pressure roller 8 may be selectively placed on and removed from the blanket cylinder surface 18.

It is preferable that the incremental transport of the wash cloth or of the polishing cloth, depending on whether the web is wet or dry, does not take place as described, but that a gear unit be provided to transmit the rotational motion of the pressure roller 8 caused by the pawl wheel 11 to the take-up roller 3. The transmission ratio is selected such that the take-up roller 3 rotates faster or at least the same as the pressure roller 8 independently of the actual amount the take-up roller 3 has wound up. In addition, there is a slip clutch in the gear tension between the two rollers 3 and 8. Furthermore, a brake engages the magazine roller 10. By these means, a constant incremental length of the wash cloth web is transported with each step of the pawl and the wash cloth web is always under a relatively constant and sufficient lengthwise tension.

The rewinding of the unused wash cloth from the take-up roller 3 to the magazine roller 10 may be superfluous if the unused wash cloth is drawn up onto the magazine roller 10 and then is conducted around the rollers 9, 8, 9 and 3, and fastened onto the take-up roller 3.

In operation of the mechanism as so far described, the wash cloth web 4 is initially pre-wetted by cleaning fluid being fed through the spray tube 19 and the spray jets 20 to the wash cloth. The wet part of the wash cloth 4 is transported so far that it lies against the pressure roller 8. This takes place when the mechanism 25 is swung to one side, i.e., it is swung to the left in FIG. 2 around the trunnions 21 in the direction of the arrow 27. Subsequently, the mechanism 25 is turned on, i.e., it is swung to the right in the direction of the arrow 27. The surface 18 is washed by the blanket cylinder 22 turning in the direction of the arrow 23. In the described position, the cylinder 22 rotates at least once through 360°.

After a predetemined number of revolutions of the blanket clyinder 22, the mechanism 25 is again turned off and a new piece of wet wash cloth web 4 is brought into working position. The mechanism is then turned on again so that the desired operation can be repeated as many times as desired. In addition, the cleaning fluid applied to the wash cloth web 4 can be varied during successive cycles of operation of the mechanism 25 to remove different contaminants on the blanket cylinder 22.

The blanket cylinder surface 18 is now clean. To dry the surface, the described operation is repeated a sufficient number of times; however, a dry polishing cloth is applied on the blanket cylinder surface 18, i.e., the spray jet 19 is not actuated during these working steps and the cloth web 4 performs the drying operation. Clearly, such drying cycles can also be used between various washing cycles.

After drying of the blanket cylinder surface 18, the mechanism 25 is shut-off again and the washing program is concluded.

The described steps for washing the blanket cylinder surface 18 may take place under the control of a suitable automatic mechanism.

Figure 3:
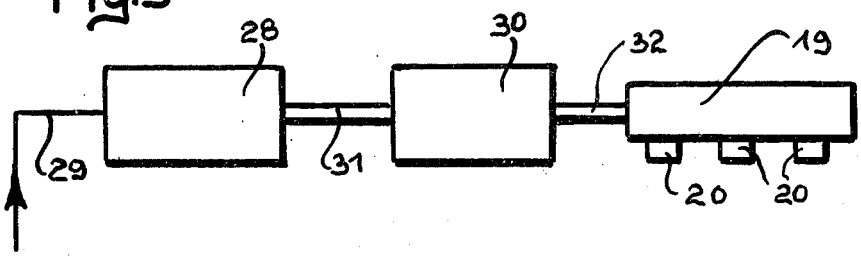
FIG. 3 is a block diagram of the operation of the spraying tube.

In a block diagram, FIG. 3 shows the important parts of the control mechanism for feeding the washing fluid into the spray tube 19. The "spray" command comes from the aforementioned automatic wash program to a premixer 28 over a signal line 29. A delivery valve 30, which is connected via a line 31 to the premixer 28, sits directly on a feed tube 32 for the spray tube 19 with the spray jets 20.

Figure 4:
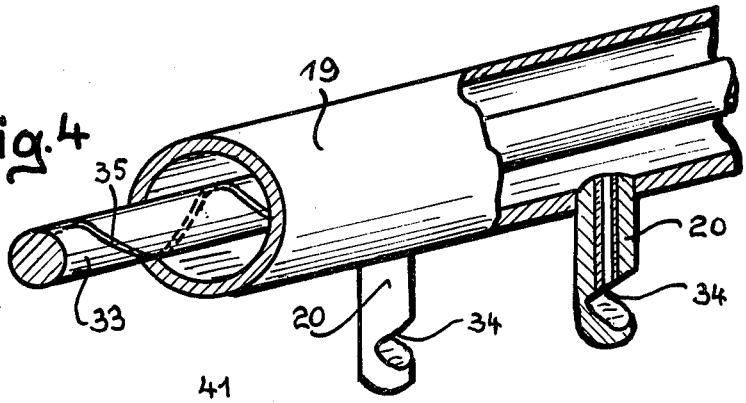
FIG. 4 is a perspective schematic view of a part of the spray tube with the spray jets and the inserted baffle plates.

FIG. 4 shows the details of a preferred embodiment of the spray tube 19. From this arrangement, it is clear that a baffle plate 33, for example, in the form of a rod, may be inserted into the spray tube 19. The result is a tangible reduction of the cross-sectional area of the spray tube 19. The small amount of washing medium in the spray tube is again intensively mixed before exiting from the jet bore holes 34 of the spray jets 20. These jet bore holes 34 direct the spray to the wash cloth web 4 immediately adjacent to the pressure roller 8.

In addition, spiral ridges 35 or similar means can be mounted around the circumference of the baffle plate 33. Such means also make the streaming cleaning fluid more turbulent.

Ideally, the cross-sectional area of the spray tube 19 should be about 3/10 of the cross-sectional area of all of the spray jets 20.

Figure 5:
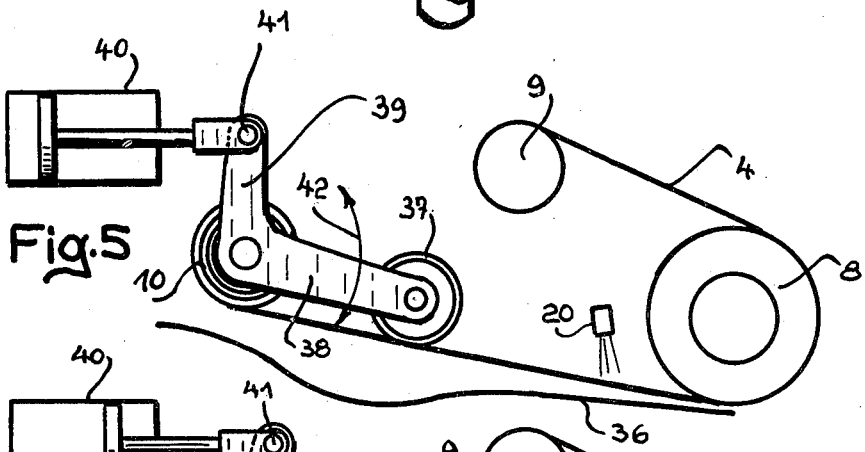
FIG. 5 is also a schematic side view of an additional control device for immersing the wash cloth in the catch pan; and, FIG. 6 is similar to FIG. 5 with the wash cloth immersed in the catch pan.
Figure 6:
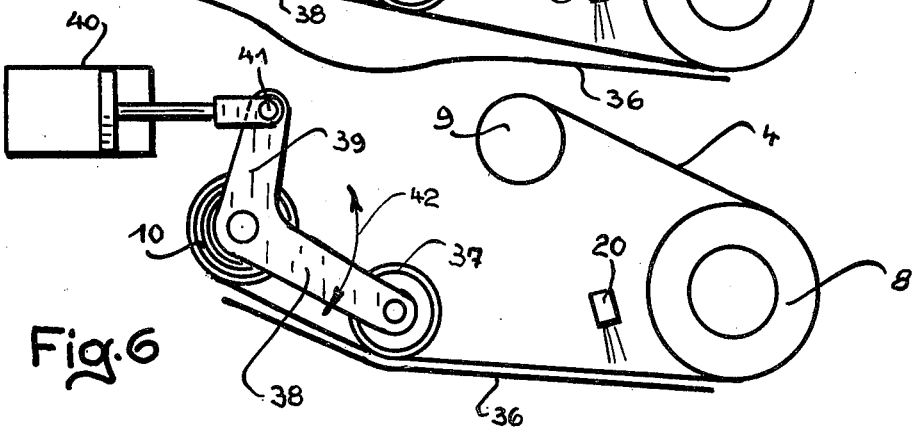

FIGS. 5 and 6 show a catch pan 36 under the spray tube 19 in which any cleaning fluid which drops through the wash cloth web and the polishing cloth 4 can be collected. In this embodiment, the wash cloth 4 is conducted from the magazine roller 10 to the pressure roller 8 over a traversable roller 37 which is mounted on both sides in rotatable lever arms 38. The bearings for the lever arms 38 can be mounted on the shaft of the magazine roller 10. The other ends 39 of the lever arms 38 are connected to the piston rod of an air cylinder 40. The lever arm ends 39 are also connected over rod 41 to each other. The piston rod of the air cylinder 40 engages the rod 41.

When actuating the air cylinder 41 from the position of rest shown in FIG. 5 to operating position according to FIG. 6, the lever arms 38 move in the direction of the arrow 42. In the position shown in FIG. 6, the traverse roller 37 is immersed in the catch pan 36 so that it is wiped out by the wash and polishing cloth 4. The cloth is moistened additionally by this. Subsequently, the starting position according to FIG. 5 may be restored through the cycle control of the air cylinder 40. The air cylinder 40 may also be controlled in cycles with the automatic wash program previously described.

While there has been shown and described what is considered to be preferred embodiments of the present invention, it will be obvious to those skilled in the art that various changes and modifications may be made therein without departing from the invention as defined in the appended claims.

I claim:

1. A mechanism for cleaning a driven blanket cylinder of an offset lithographic printing press comprising a magazine roller, a wash cloth web, means for incrementally advancing the wash cloth from the magazine roller, a pressure mechanism which may be pressed against the blanket cylinder to be cleaned and over which the advancing wash cloth web is incrementally moved in a transport direction, means for moving the pressure mechanism into and out of contact with the driven blanket cylinder with the wash cloth web therebetween, the pressure mechanism including a pressure roller, the wash cloth being incrementally advanceable while the pressure roller and driven blanket cylinder are out of contact, a take-up roller for rewinding the wash cloth web, and means in juxtaposition to the pressure roller for selectively dispensing at least one cleaning fluid onto the wash cloth immediately before the wash cloth contacts the pressure roller so that cleaning of the driven blanket cylinder can be accomplished at operational speeds of the lithographic printing press.

2. A mechanism according to claim 1, wherein the means for dispensing cleaning fluid includes a spray tube in juxtaposition to the pressure roller.

3. A mechanism according to claim 2, wherein the spray tube is arranged directly above a section of the wash cloth web to be sprayed.

4. A mechanism according to claim 3, wherein a baffle plate is inserted into the cross-section of the spray tube to agitate the cleaning fluid.

5. A mechanism according to claim 4, wherein means are applied to the baffle plates to agitate the cleaning fluid additionally during its transport through the spray tube.

6. A mechanism according to claim 5, wherein under the spray tube and the section of the wash cloth web to be moistened with the spray tube there is a pan for collecting the cleaning fluid.

7. A mechanism according to claim 6, wherein a control mechanism is provided which selectively immerses the wash cloth web into the pan.

8. A mechanism according to claim 1, wherein there is further included a pan for containing the cleaning fluid under the section of the wash cloth web to be moistened with that cleaning fluid.

9. A mechanism according to claim 8, wherein there is further included means for selectively immersing a portion of the wash cloth web in the pan.

10. A mechanism according to claim 1, wherein there is further included means for continually retaining a preset tension in the wash cloth web.

* * * * *